US005709523A

United States Patent [19]

Ware

[11] Patent Number: 5,709,523

[45] Date of Patent: Jan. 20, 1998

[54] MATERIAL HANDLING LIFT

[76] Inventor: Emmet P. Ware, 12103 S. Broadway, Peck, Kans. 67120

[21] Appl. No.: 484,432

[22] Filed: Jun. 7, 1995

[51] Int. Cl.[6] ..... B66F 9/06

[52] U.S. Cl. ..... 414/715; 414/642; 414/728; 414/664

[58] Field of Search ..... 254/10 R, 10 C; 414/917, 663, 785, 664, 662, 668, 671, 659, 660, 549, 685, 697, 700, 701, 706, 708, 712, 710, 715, 716, 728, 742, 743, 589, 590, 546

[56] References Cited

U.S. PATENT DOCUMENTS

| | | | |
|---|---|---|---|
| 2,672,995 | 3/1954 | Drott | 414/715 |
| 2,849,132 | 8/1958 | Clarke . | |
| 3,045,850 | 7/1962 | Carr et al. | 414/607 |
| 3,155,251 | 11/1964 | Williamson | 414/712 X |
| 3,198,359 | 8/1965 | Lull . | |
| 3,333,716 | 8/1967 | Ziegler | 414/728 X |
| 3,379,325 | 4/1968 | Frey . | |
| 3,407,947 | 10/1968 | Valla | 414/708 X |
| 3,647,099 | 3/1972 | Carriere . | |
| 3,700,132 | 10/1972 | Waters | 414/715 X |
| 3,802,589 | 4/1974 | Holtkamp . | |
| 4,147,263 | 4/1979 | Frederick et al. | 414/718 |
| 4,215,971 | 8/1980 | Itey-Bernard | 414/728 X |
| 4,278,390 | 7/1981 | Ahearn | 414/728 X |
| 4,636,133 | 1/1987 | Hess | 414/715 |
| 4,755,100 | 7/1988 | Schultz et al. | 414/664 X |
| 5,244,336 | 9/1993 | Engler et al. | 414/642 |
| 5,413,454 | 5/1995 | Movsesian | 901/1 X |

FOREIGN PATENT DOCUMENTS

| | | | |
|---|---|---|---|
| 21480 | 1/1981 | European Pat. Off. | 414/728 |

OTHER PUBLICATIONS

The Shoplifter—By Keystone Specialty Machines.
Big Joe Walkies—A Guide to The World's Largest Line of Practical Lift Trucks FLB-1088.
Challenger XT—Big Joe XT 1-86.
PDI—Power Drive Intermediate-duty—Big Joe PDI 786.
SSC—Stock Selector Counterbalanced—Big Joe © 1976.
PDC—Power Drive Counterbalanced—Big Joe—1-88.
PTW—Powered pallet truck—Big Joe PTW 10-84.
PTR—Walkie Rider Pallet Truck—Big Joe 2-86.
WPT—Walkie Powered Pallet Truck—Big Joe © 1990.
PDM—Power Drive Medium Duty Straddle Trucks—Big Joe © 1989.
PDH—Power Drive Heavy Duty Straddle Trucks—Big Joe © 1990.
PDC/PDCM—Power Drive Counterbalanced Trucks—Big Joe © 1990.
PDR—Power Drive Reach Trucks—Big Joe © 1989.
XT/IBH—In-Between Handling Lift Trucks-Big Joe © 1991.

*Primary Examiner*—Frank E. Werner
*Attorney, Agent, or Firm*—Herzog, Crebs & McGhee, LLP

[57] ABSTRACT

A material handling lift having a movable frame, a mast mounted at one end to a shuttle assembly movable on the frame, and a load handling assembly attached to the mast by means of two extending arm members. The frame comprises two longitudinal C-shaped side rails in which the shuttle assembly can be reciprocated by wheels which engage the inner surfaces of the rails. The sections of the wheels which engage the rails are arched to prevent the lift from tipping when the lift is moving in a sloped direction. Guide wheels mounted on the shuttle assembly rotate across the surfaces of the sides of the upper rails, thereby stabilizing movement of the shuttle assembly along the rails. The shuttle assembly can be sustained in any position along the rails by operation of a hand-operated shuttle brake. The load handling assembly is characterized by a pair of forks adjustably mounted on two horizontally parallel bars, the lower bar attached to a curved extension arm which can be raised or lowered by means of a hydraulic cylinder, and the upper bar attached to a tie bar assembly extended and retracted by a hydraulic cylinder, thereby tilting the forks forward or backward, respectively. The lift can be easily disassembled and packaged in a crate to be shipped by the removal of five pins.

20 Claims, 16 Drawing Sheets

MATERIAL HANDLING LIFT

BACKGROUND OF THE INVENTION

1. Field of Invention

This invention relates to shop lifts of the type used for jobs that require the lifting and moving of heavy loads in the work place and, more particularly, to a versatile material handling lift which can lift a load and transport it to a precise position.

2. Description of the Prior Art

Shop lifts for use around the workplace must generally be small enough for versatile movement, such as for passing through doors and down hallways. Thus, the standard means for moving a load in the workplace is by the use of a lift cart having a fork assembly rather than using a conventional riding forklift. However, because the design of lift carts usually only provide for vertical movement of the loads on the apparatus, loads generally cannot be precisely placed in positions where the apparatus itself cannot be driven. Therefore, one or more persons may still be required to lift or drag the load onto or off of the lift. As a result, lifting related accidents such as bodily injury or damage to the workpiece or workplace may occur.

Therefore, it is a primary object of this invention to augment the operation of moving heavy loads by providing a lift which enables one person to maneuver 1,000 lbs. or less and reduce the lifting or dragging of the load onto or off of the lift.

One kind of prior art material handling lift is exemplified by "The Shoplifter," which is manufactured and distributed by Keystone Specialty Machines, Inc. through EDM Publications, 230 West Parkway, Unit 3-1, Pompton Plains, N.J. 07444. "The Shoplifter" provides horizontal movement of the load by a shuttle carriage which moves forwards and backwards along a pair of rails in similar manner to train on train tracks. The apparatus also includes width-adjustable forks to convey small but heavy articles into confined or small openings. Furthermore, the forks can be tilted up or down by a four-knob wheel for simpler unloading.

However, such prior art shop lifts such as the "Shoplifter" have their shortcomings. These lifts cannot permit the load to remain in an adjustable range throughout the entire up, down, and lift cycle.

It is thus another object of the present invention to provide a material handling lift that overcomes the shortcomings of the prior art by a versatile, hydraulic controlled lift.

SUMMARY OF THE INVENTION

The present invention provides a material handling lift that has a fork assembly carried and controlled by two arms that are operably attached to a shuttle assembly. The shuttle assembly is connected between and rides on a pair of rails. The shuttle assembly is reciprocal along the rails and includes a manually operated brake that is normally biased to fix the shuttle assembly with respect to the rails. Upon actuation by the operator, the shuttle assembly may be longitudinally moved back and forth for positioning the associated fork assembly relative to the load.

The shuttle assembly has a mast which includes a rearward bend and carries a lifting arm that is attached to the fork assembly for lifting the fork assembly and a tilt arm that is operably connected to the fork assembly for limitedly tilting the fork assembly with respect to ground.

According to one aspect of the present invention, the rails are defined by a C-shaped channel in which radiused wheels of the shuttle assembly ride. Specifically, the rails are defined by an upper plate and a lower plate that are separated by a transverse plate, thereby defining a C-shaped channel or track. Preferably, the transverse plate is one side of a rectangular tube, the rectangular tube providing rigidity to the track rail.

The material handling lift utilizes hydraulic cylinders to control the vertical lift and tilt of the fork assembly. The hydraulic cylinders are coupled to a hydraulic circuit including a pump and motor that is connected to an onboard power supply. The operator controls the hydraulics through a detachable hand control. According to an aspect of the present invention, the hand control may be detachable from the system which renders the material handling lift inoperable.

The shuttle assembly is supported by wheels disposed within the track rails. The track rails are coupled at an end thereof by a transverse number to thereby define a frame. The frame is movably supported on a front pair of wheels, and a rear pair of wheels that are preferably castors. The frame also includes a foot brake for releaseably fixing the movement of the lift. The lift arm that controls the vertical movement of the fork assembly includes a downward bend with relation to the angled mast and shuttle assembly for distributing the load carried by the fork assembly onto four bearing points on the shuttle assembly. The wheels of the shuttle assembly are radiused wheels and are disposed approximately at the bearing points such that an equal weight distribution is maintained on the shuttle assembly during handling of the load.

According to another aspect of the present invention, the mast, lift arm, hydraulic lift cylinder and the tilt arm are coupled together and to the respective parts of the lift by removable pins and pin clips. This allows the breakdown or disassembly of the lift for packing the same in a relatively small shipping container. Additionally, the material handling lift weighs between 500 and 600 lbs.

In one form thereof, the material handling lift comprises two longitudinal spaced rails each rail defining a longitudinal C-shaped channel. Disposed between the rails is a shuttle assembly having radiused wheels that ride within the C-shaped channel allowing limited longitudinally reciprocal movement therein. The rails forming a frame are carried by a pair of front wheels and a pair of rear castors for manually guiding the lift.

An angled mast is coupled to the shuttle assembly at one end thereof and extends rearwardly and upwardly terminating in a pair of operator handles. At the top of the mast, a first or tilt arm is pivotally coupled thereto and includes a double acting hydraulic cylinder for extending and retracting the first arm. The first arm is pivotally coupled at the other end to the top of a fork assembly. Disposed below the first arm is a second arm pivotally coupled to the mast and extending therefrom to the fork assembly where the second pin is pivotally coupled thereto. The second arm may consist of two (2) members joined by one or more transverse members and includes a downward bend at which point is connected one end of a single acting hydraulic lift cylinder. The other end of the hydraulic lift cylinder is coupled to the shuttle assembly. This cylinder extends and retracts to provide lifting and lowering of the fork assembly. The fork assembly includes an upper and lower bar, with the upper bar being pivotally coupled to the first arm and with the lower bar being pivotally coupled to the second arm. Two angled forks are limitedly movably disposed on the upper and lower bar limited in their width by end bars. The forks are thus able to widen and contract accommodating various sized loads.

The lift additionally includes a rechargeable battery that provides an onboard power supply and a hydraulic system for powering the hydraulic lift and tilt cylinders including a pump, motor, and associated control valves. Operably coupled to the power source and the hydraulic system is control module that is preferably a detachable hand control for remote lifting and angling of the load.

Because of the angle of the mast and the angle of the lifting arm, the present material handling lift is designed to distribute the weight of the load to four bearing points constituting a rectangle on the shuttle assembly. The fork assembly is adapted to be adjustable in width for accommodating the size of the load and allows a load larger than the width of the rails to be lifted and conveyed as well as a load that is smaller than the width of the rails. While utilizing lift up down, shuttle forward-back, and tilt forward back features, the operator can literally place an object within thousands of an inch of its destination.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION OF THE PREFERRED EMBODIMENT

Figure 6:
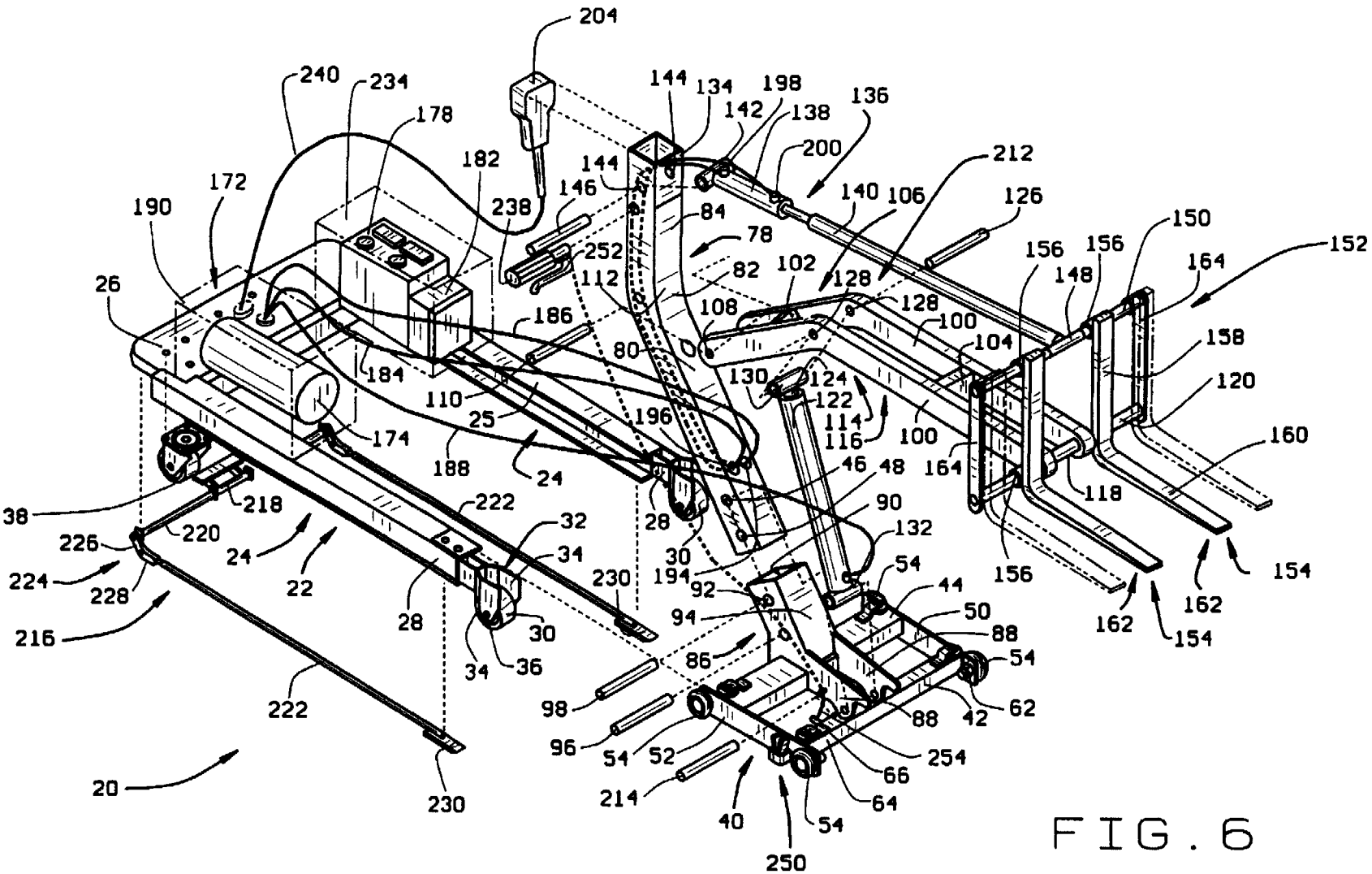
FIG. 6 is an exploded perspective view of the disassembled components of the present lift invention, particularly indicating the parts which are connected by pins.
Figure 14:
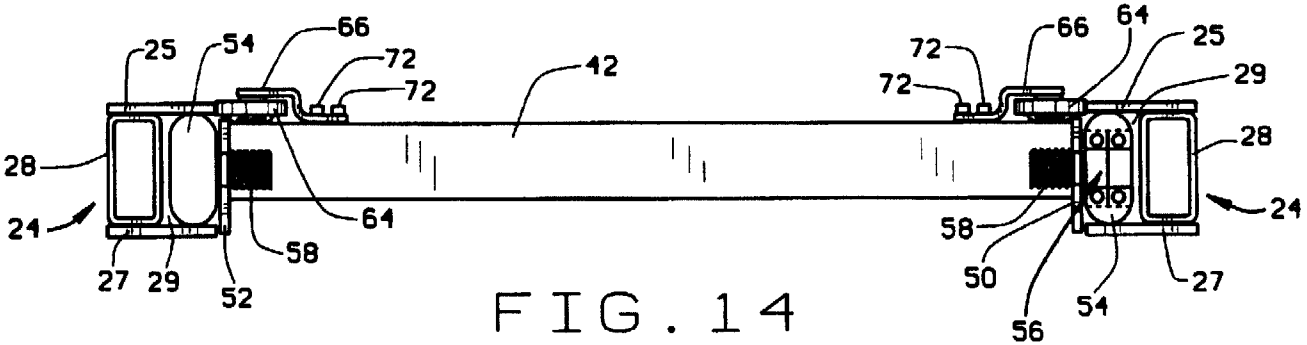
FIG. 14 is a further enlarged fragmentary front view of the shuttle assembly showing the wheels of the shuttle assembly engaging the rails of the material handling lift.
Figure 15:
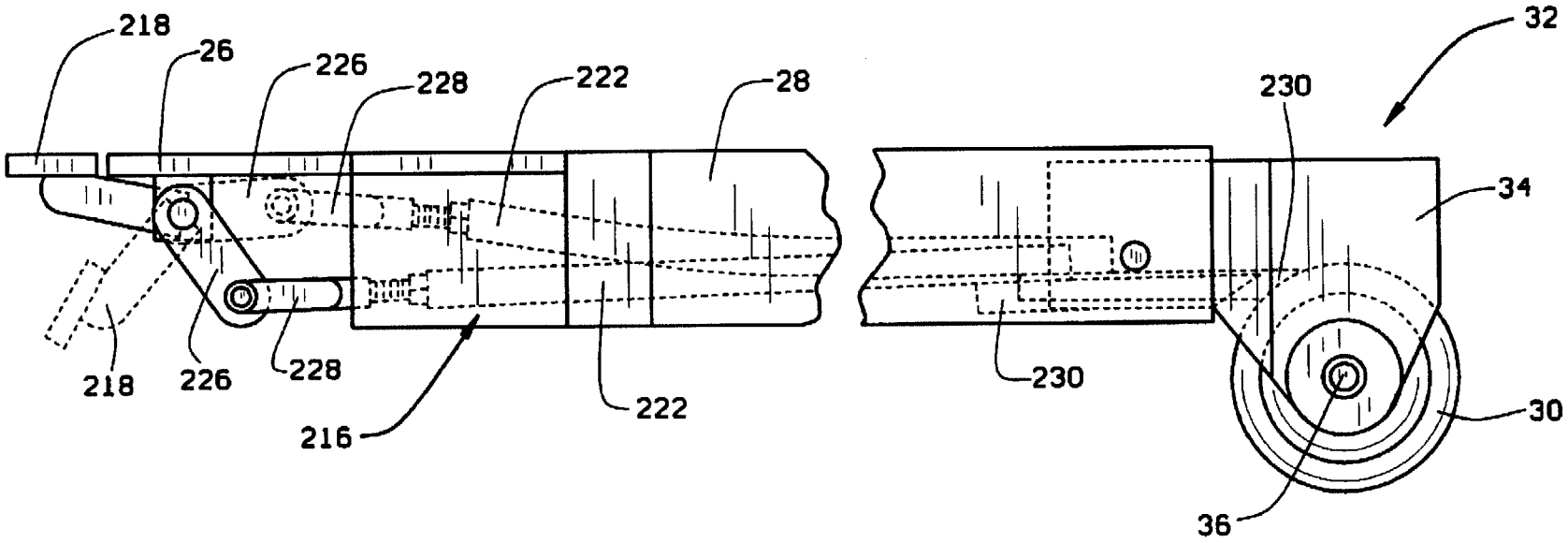
FIG. 15 is an enlarged fragmentary view of the foot brake assembly disengaged, showing in broken lines the foot brake assembly engaged.

Referring to FIG. 6, the material handling lift according to the present invention is indicated generally at 20. The lift 20 includes a frame 22 comprising two identical laterally spaced longitudinal side or track rails 24. As best seen in FIG. 14, each track rail 24 is defined by an upper rail plate 25 and a lower rail plate 27 and a hollow rectangular tubing 28 which is positioned with its two shorter sides contacting the upper surface of the lower rail plate 27 and the lower surface of the upper rail plate 25 with one of its longer sides upper and lower rail plates 25, 27 a channel 29 within the outward ends of the rails 24. Thus, the rails 24 each have a C-shaped longitudinal channel 29. The tubing 28 extends a short distance beyond the full lengths of each of the rails 24. The rails 24 are connected at their rearward ends by a transverse support member 26.

The frame 22 is elevated and movable by four wheels. The two front wheels 30 are each attached to the frame 22 by two wheel housings 32, each of which consists of two identical plates 34 attached to one of the vertical sides of the tubing 28 extending from the rails 24. The plates have mirroring holes for insertion of pins 36 which attach the front wheels 30 to the plates 34. The two rear wheels 38 are each attached to the support member 26. In this configuration, the front wheels 30 are only movable in the forward and backward positions with respect to the frame 22 and the rear wheels 38 are actually casters, which are rotatably movable in all directions. Thus, the front wheels 30 are for driving and the rear wheels 38 are for steering.

Figure 13:
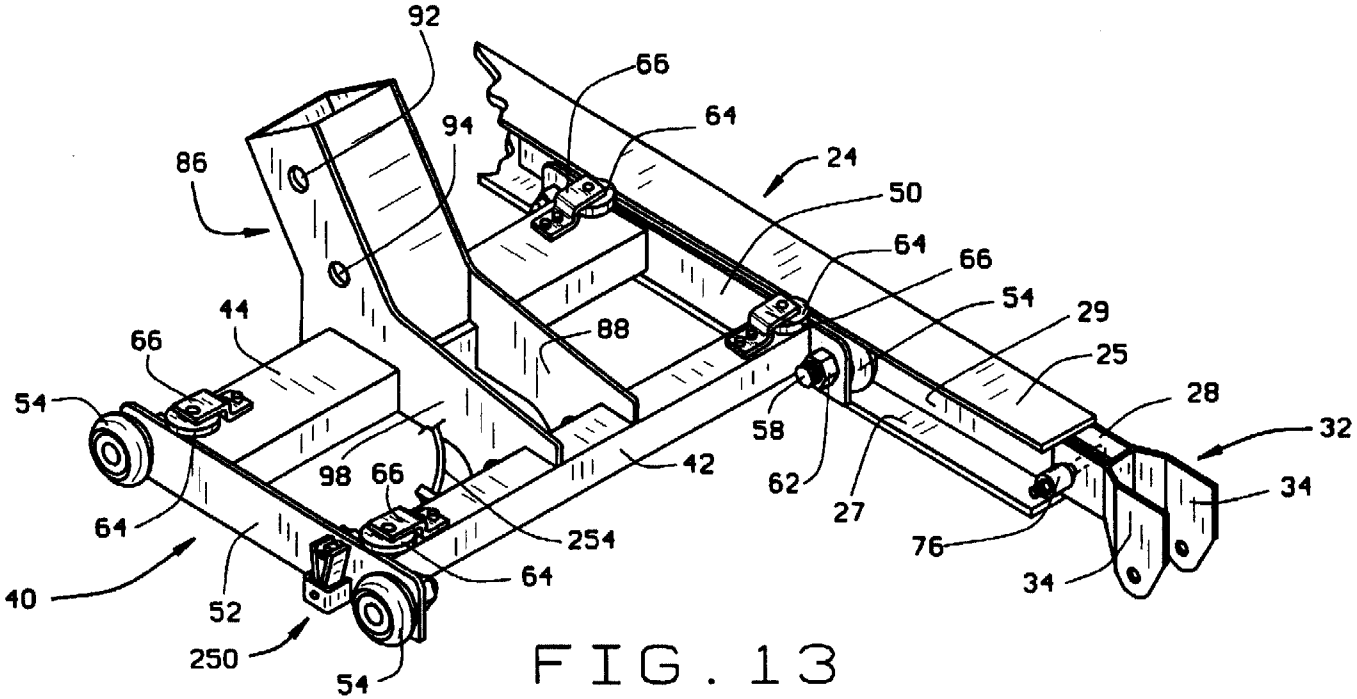
FIG. 13 is an enlarged fragmentary perspective view of the shuttle assembly on a rail of the material handling lift.

A shuttle assembly 40, as best seen in FIG. 13, is positioned for reciprocating longitudinal movement between and along the rails 24 of the frame 22. The shuttle assembly 40 includes two laterally spaced elongated support members, a front support member 42 and a rear support member 44. The support members 42 and 44 are joined together at their outer ends by two longitudinal crossmembers, endplates 50 and 52, which extend beyond the ends of the support members 42 and 44 to allow space for the attachment of each of the four radiused shuttle wheels As seen in FIG. 14, the radiused shuttle wheels 54 are rotatably mounted on the outward facing ends of the endplates 50 and 52 by bearing shafts 56 which position the shuttle wheels 54 in rolling engagement with the upper surface of the lower rail plate 27 and the lower surface of the upper rail plate 25 and thus within the channels 29 of rails 24. The bearing shafts 56 have threaded ends 58 which lie on the inwardly facing sides of the endplates 50 and 52. Nuts 62 are threaded onto the threaded ends 56 of the bearing shafts 56 for securing the wheels to the end plates 50 (as seen in FIG. 13). The shuttle assembly 40 is stabilized along the rails 24 by guide wheels 64, which rotate across the surfaces of the sides of the upper rail plates 25.

Figure 16:
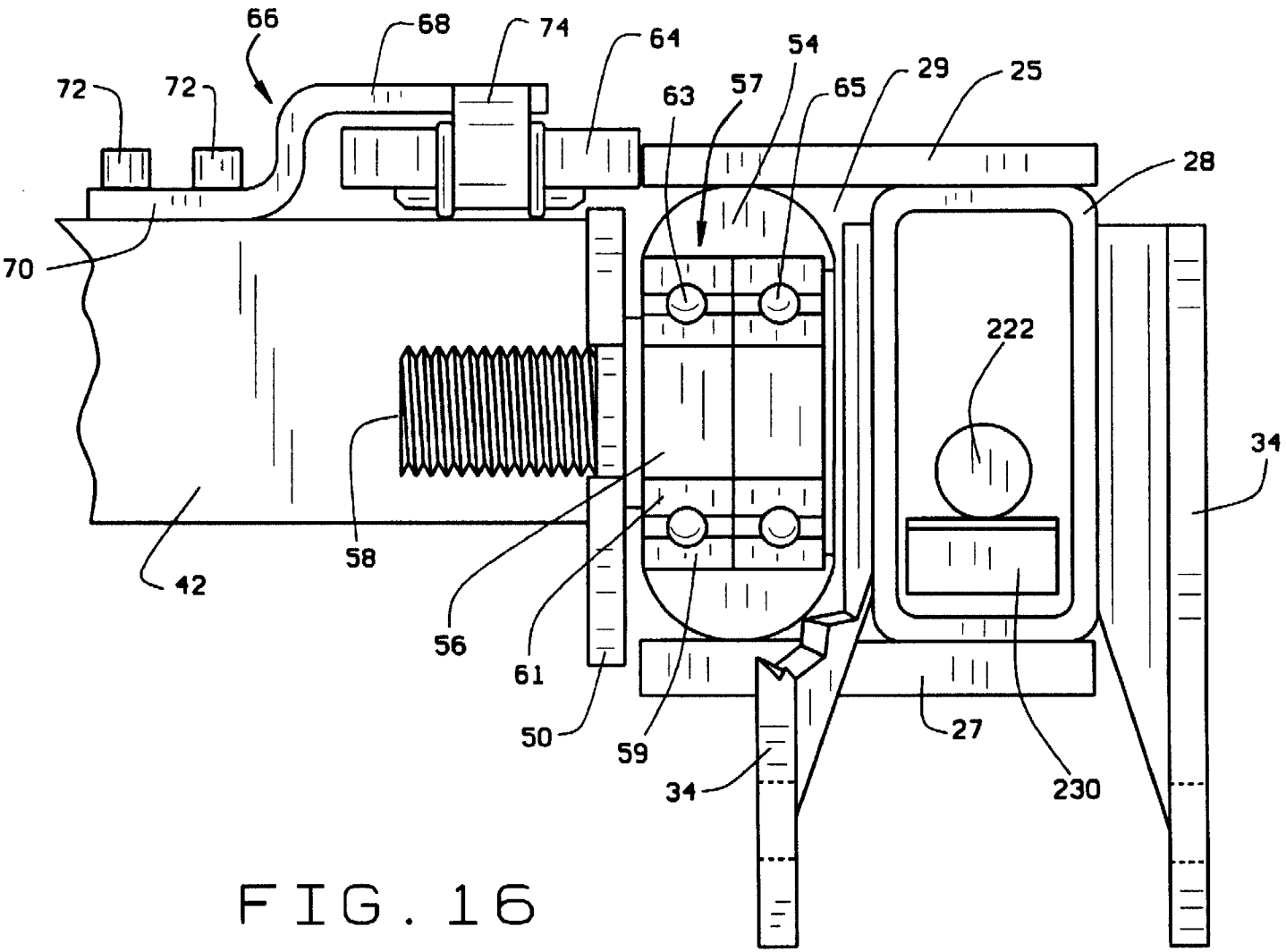
FIG. 16 is an enlarged fragmentary elevational view of the shuttle assembly wheel engaged with a rail.

As best illustrated by FIG. 16, the guide wheels 64 are mounted to the top ends of the support members 42 and 44 by means of S-shaped brackets 66 with elongated upper ends 68 and lower ends 70. The lower ends 70 of the brackets 66 are fastened to the support members 42 and 44 by screws 72. Pins 74 connect the upper ends 68 of the brackets 66 to the guide wheels 64. The pins 74 are cylinder-shaped and extend through the centers of the guide wheels 64, thereby functioning as a vertical axis for rotatable movement. Additionally, illustrated in FIG. 16, the bearing shafts 56 are fixed to a ball bearing assembly 57 consisting of a radially outer annular sleeve 59 and a radially inner annular sleeve 61 separated by a plurality of axially inner ball bearings 63 and a plurality of axially outer ball bearings 65. Rotatably disposed on the radially outer annular sleeve 59 is the radiused wheel 54. By providing radiused wheels 54 within the channels 29 of the rails 24, uneven stresses such as twisting and bending imparted to the shuttle assembly by the load will not bind the wheels 54 therein.

Because of the overall design of the present lift 20, the shuttle assembly 40 bears the weight of the load to be lifted and transported. Specifically, the bearing shafts 56 are located at the four corners of the shuttle assembly 40 to equally bear the weight of the load, thus the load or bearing points.

Figure 4:
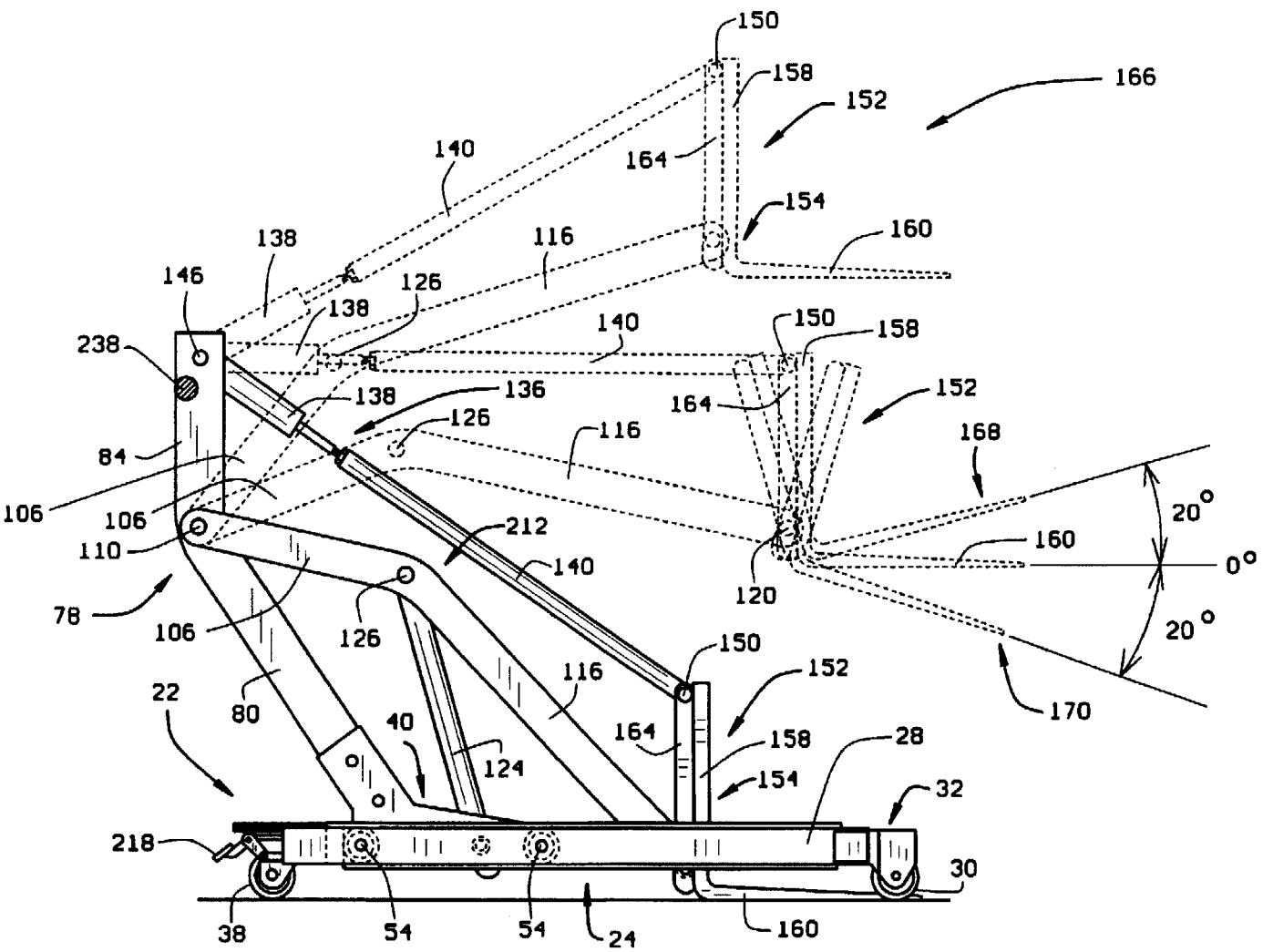
FIG. 4 is a side elevational view of the present material handling lift with the shuttle assembly in its back most position and the fork assembly in its downmost position, and indicating by broken lines the lift assembly in its range of position.
Figure 5:
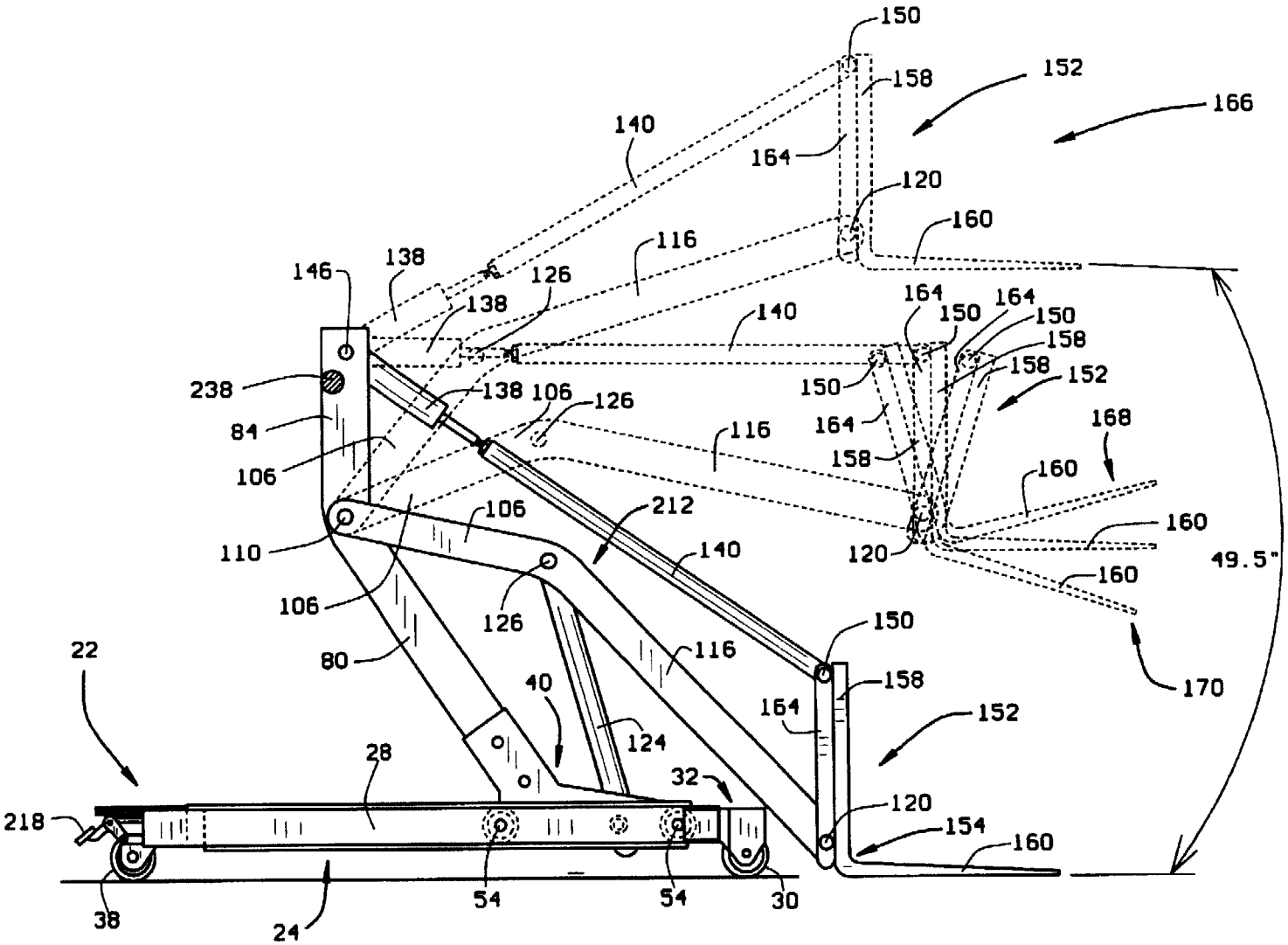
FIG. 5 is a same side elevational view as in FIG. 4 depicting shuttle assembly in its frontmost position.

The shuttle assembly 40 can be reciprocated along the entire length of the rails 24, as best seen in FIGS. 4 and 5. In FIG. 4, the shuttle assembly 40 is positioned in its rearmost position along the rails 24. In FIG. 5, the shuttle assembly 40 is positioned in its frontmost position along the rails 24. Maximum forward and backward movement of the shuttle assembly 40 is defined by stop pins 76 at the front and the support member 26 at the rear. As seen in FIG. 13, the stop pins 76 are attached to the frontward extending ends of the tubing 28 to prevent the shuttle wheels 54, and thus the shuttle assembly 40, from projecting beyond the front ends of the rails 24.

Referring back to FIG. 6, the mast structure 78 is secured to the shuttle assembly 40 on and between the front support member 42 and the rear support member 44. The mast 78 has a diagonal base 80 which extends upwards and backwards with respect to the frame 22. The base curves, shown generally at 82, and terminates into a vertically extending center column 84. The mast 78 is rigidly attached to the shuttle assembly 40 by means of a bracket 86 which is centered on the rear support member 44. The bracket 86 encases the top and sides of the rear support member 44 and has two arms 88 which extend to and are attached onto the front support member 42. The bracket 86 has a rectangular cavity 90 that is shaped to conform to the base 80 of the mast 78. The bracket 86 has two parallel spaced pin shafts 92 and 94 which correspond to two parallel spaced pin shafts 46 and 48 on the base 80 of the mast 78. To connect the mast 78 and the bracket 86, the base 80 of the mast 78 is inserted into the cavity 90 of the bracket 86, and the shafts 92 and 46, and shafts 94 and 48, of the bracket 86 and the mast 78, respectively, are aligned. Pins 96 and 98 are inserted into the parallel holes 94 and 92, respectively, to secure the mast 78 to the bracket 86. Pin clips or the like (not shown) are disposed at both ends of each pin 96.98 to releasably retain the pins 96, 98 in place.

Reciprocation of the shuttle assembly 40 along the rails 24 is accomplished by manually pushing or pulling the mast 78. A handlebar 238 is coupled at the top of the center column 84 of the mast 78 for the operator to grasp. The shuttle assembly 40 includes an associated brake assembly generally designed 250 disposed on one endplate 52. The brake assembly is coupled to and actuated by a bond actuator 252 disposed on the handle bar 238 by a bowden cable 254 or the like. The brake assembly 250, described with particularity hereinbelow is normally biased such that the shuttle assembly 40 can only be moved when the brake is released by the operator positively squeezing the hand actuator 252. Stated another way, the shuttle assembly 40 is positive locking when no operator is present and thereby held against longitudinal movement in any intermediate position along the rails 24 unless the brake is released. The hand brake assembly 250 is shown in FIGS. 17, 18, 19 and 20.

Figures 17, 18:
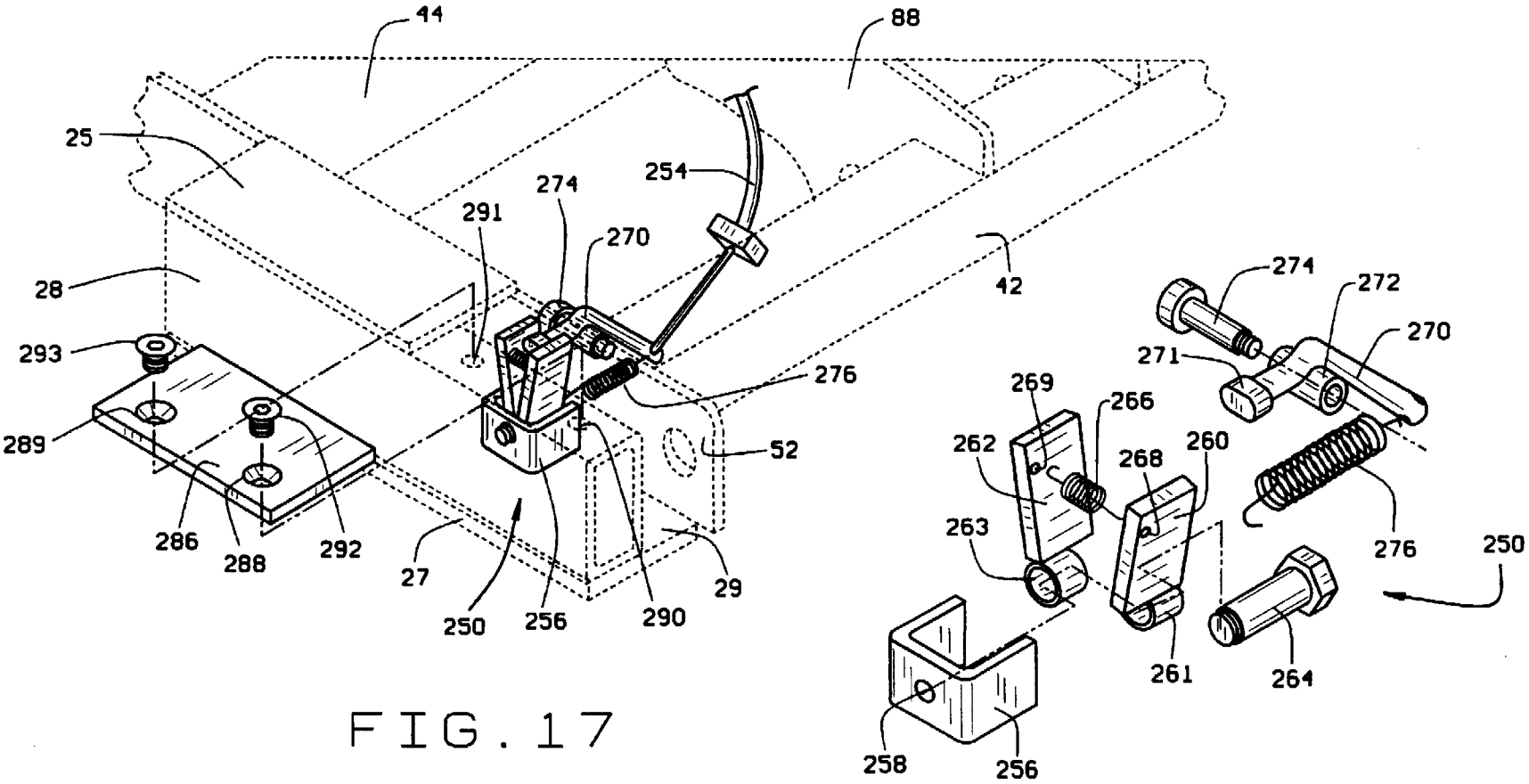
FIG. 17 is an enlarged fragmentary perspective view of the shuttle brake, the broken lines showing the shuttle assembly and the rail in relation to the shuttle brake.
FIG. 18 is an exploded fragmentary view of the shuttle brake assembly.

Referring now to FIG. 17, the brake assembly 250 is shown coupled to the side of the endplate 52 of the shuttle assembly 40 so that the brake assembly 250 extends into the channel 29. In order to reach the brake assembly 250, the top rail 25 includes a plate portion 286 that is removable to expose the brake assembly 250. The plate 286 has two bores 288, 289 that align with two bores 290, 291 disposed in the top of the rectangular tube 28 when the plate 286 is placed thereon. The plate 286 is secured to the rectangular tube 28 by two screws 296, 293 extending through respective bore pairs 288, 290 and 289, 291. With additional reference to FIG. 18, the brake assembly 250 consists of a metal U-bracket 256 having a bore 258 for receipt of a bolt 264, and two pivot plates 260, 262 each having a cylindrical bore 261, 263 at the bottom end. The bolt 264 extends through a bore in the endplate 52, through the cylindrical bores 261, 263 and the bore 258 in the U-bracket to pivotally retain the plates 260, 262. The bolt 264 is retained by a nut 265 (FIG. 19) and serves as the pivot axis.

Each plate 260, 262 has a hole 268, 269 respectively that holds an end of a biasing spring 266 so as to position the spring 266 between the plates 260, 262. The biasing spring 266 normally pulls the plates 260,262 together. The brake assembly 250 further includes an L-shaped arm 270 having a knob 271 at one end thereof that is disposed between the plates 260, 262. The arm 270 has a cylinder bore 272 attached thereto through which is received a bolt 274 that serves as a pivot axis for the arm. The bolt 274 pivotally couples the arm 270 to the front support member 42.

Figure 19:
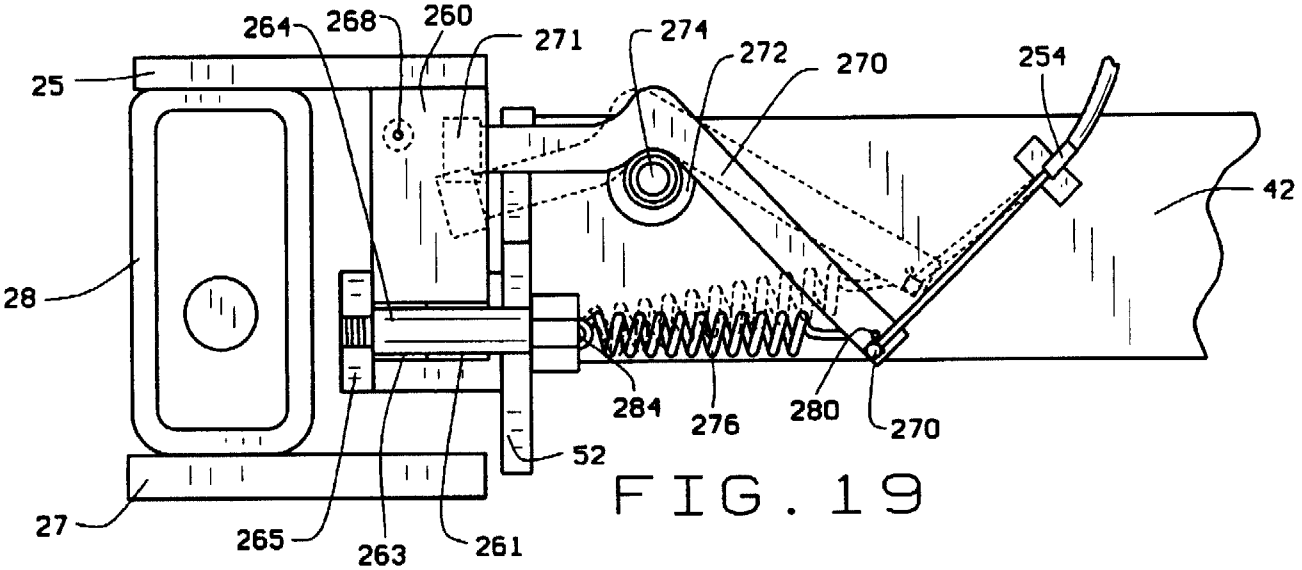
FIG. 19 is an enlarged fragmentary elevational view of the shuttle assembly brake mechanism in both the engaged and disengaged positions.

The bowden cable 254 is attached to the arm 270 at 270 for pivotally moving the arm 270 by the hand mechanism 252. A spring 276 is also attached at 280 of the arm 270 with the other end attached to a hook 284 of the bolt 264 (FIG. 19). This normally pivotally biases the arm 270 such that the knob is in the upward position.

Figure 20:
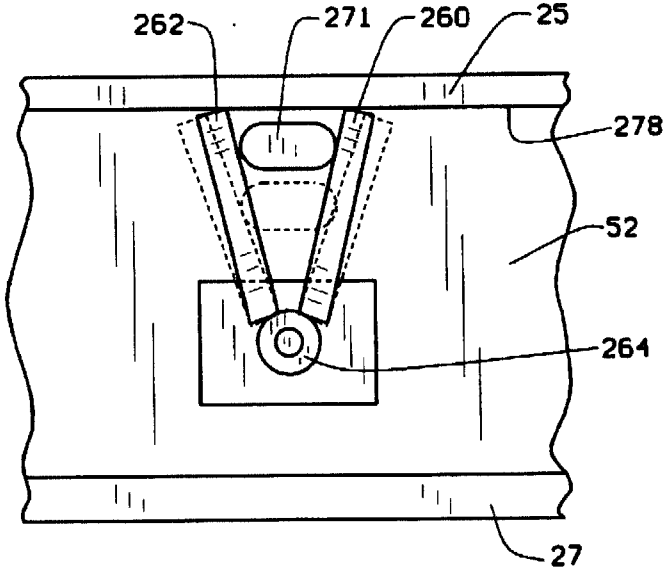
FIG. 20 is an enlarged side fragmentary elevational view of the shuttle brake assembly in both the engaged and disengaged position.

With reference to FIGS. 19 and 20, the operation of the shuttle brake 250 will now be described. In the normal state, the bowden cable 254 is caused to be pulled or relaxed by tension exerted on the end of the arm 270 by the spring 276. This causes the arm 270 to pivot about the bolt or pivot axis 274 wherein the knob 271 is in its uppermost position. While the knob 271 is in the upper position, the tension of the spring 266 pulls or pivots the plates 260, 262 together. The upper position of the knob 271 allows the ends of the plates 260, 262 to contact the lower surface 278 of the rail 25 creating a wedging effect. This wedging action prevents the shuttle assembly 40 from moving along the rails 24.

When the operator 236 wishes to move the shuttle assembly 40, the brake handle 252 is grasped thereby pulling upwardly on the cable 254. This upward pulling pivots the arm 270 causing the knob 271 to fall into its downwardmost position spreading the plates 260, 262 apart by friction, overcoming the tension of the spring 266. By spreading or pivoting the plates 260, 262 the top disengage the lower surface 278 of the rail 25, allowing the shuttle assembly 40 to freely longitudinally move on the track rails 24. As long as the operator 236 grips the handle 252 the shuttle assembly 40 may move.

Referring back to FIG. 6, an extension or arm 212 projects from the bend in the mast 78. The extension arm 212 consists of two identical parallel spaced bars 100 which are adjoined by crossbars 102 and 104 that are positioned between the bars 100. The extension arm 212 has a shorter segment 106 with holes 108 in each of the bars 100 which are pivotally connected on either side of the mast 78 by means of a pin 110 inserted into a shaft 112 in the mast 78. The pin 110 is releaseably retained by two pins clips (not shown) disposed at either ends thereof. The shorter segment 106 curves, the bend shown generally at 114, into a longer segment 116. The ends of the bars of the longer segment 116 contain circular holes 118 in which a bar of substantially equal diameter to the holes 118 is slidably mounted, hereinafter the lower bar 120.

The extension arm 212 is raised and lowered by hydraulically operated means. This means is preferably a single acting hydraulic lift cylinder 122, the piston of which has its rod 124 pivotally mounted between the two bars 100 of the extension arm 212 by means of a pin 126 extending through the holes 128 in the bend 114 of the extension arm 212 and through a cylindrical shaft 130 located on the rod 124. The pin 126 is releasably retained by two pin clips (not shown) at either ends thereof. The rear end of the hydraulic lift cylinder 122 also has a cylindrical shaft 132 which is pivotally connected by a pin 214 to the arms 88 of the bracket 86 on the front support member 42 of the shuttle assembly 40. Again the pin 214 is releaseably retained by two pin clips (not shown) disposed at either ends thereof. The hydraulic lift cylinder 122 has a flow compensating control valve permanently built-in to insure the slow and even descent of the extension arm 212 under evacuation of hydraulic fluid during the down cycle.

Pivotally connected above the extension arm 212 assembly in a rectangular cavity 134 on the front of the center column 84 of the mast 78 is a tie bar assembly 136. The tie bar assembly 136 includes a hydraulic tilt cylinder 138 and a tilt arm 140, the piston rod of the hydraulic tilt cylinder 138 securely fastened to one end of the tilt arm 140. The rear end of the hydraulic tilt cylinder 138 has a cylindrical shaft 142 which is inserted in the cavity 134 of the mast 78 and aligned with two parallel holes 144 on the sides of the mast 78, a pin 146 then being inserted to secure the mast 78 and shaft 142. Again, the pin 146 is releaseably retained therein by two pin clips (not shown) disposed at either ends thereof. The opposite end of the tilt arm 140 is a cylindrical shaft 148 which receives a slidably mounted cylindrical bar, hereinafter upper bar 150. The cylindrical shaft 148 allows pivoting.

Figure 10:
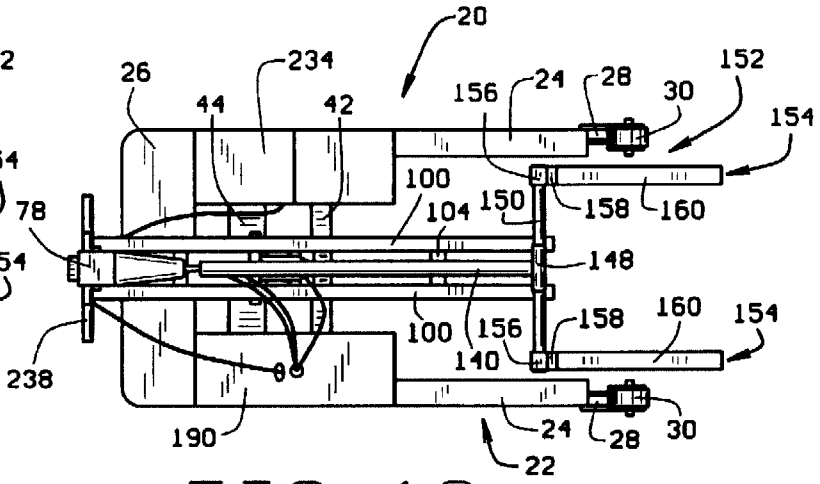
FIG. 10 is a top elevational view of the material handling lift with the forks in their widest position.
Figure 9:
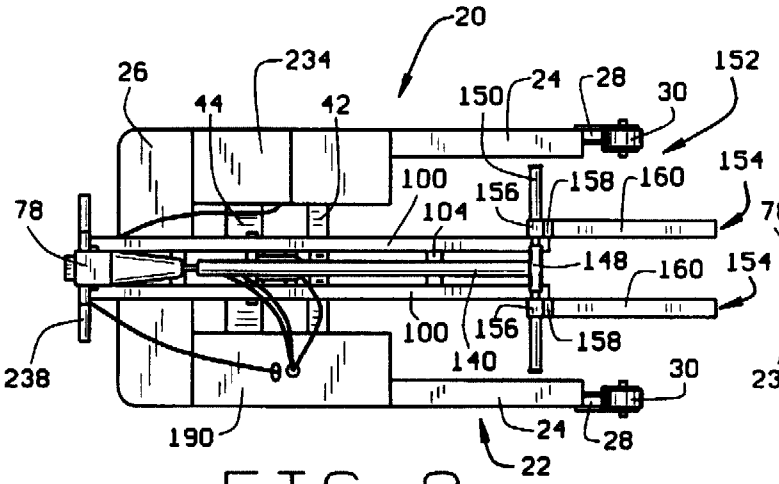
FIG. 9 is a top elevational view of the material handling lift with the forks in their narrowest position.

A load handling assembly 152 comprising two identical forks 154 in parallel spaced relationship is slidably mounted on the upper and lower bars 150 and 120, respectively, by means of rearwardly projecting cylindrical shafts 156 attached to the forks 154. Each fork 154 comprises a generally L-shaped member with a 17-inch long vertical upper portion 158 and a 2-inch wide and 1-inch thick horizontal lower portion 160 which tapers to a ¼-inch tip 162. The width of the forks 154 are adjustable to enable the placement of small but heavy loads into confined or small window areas. As shown in FIG. 9, the minimum width between the forks 154 is the distance between the outer edges of the bars 100 comprising the extension arm 212. As shown in FIG. 10, the maximum width the forks 154 can traverse along the length of the upper and lower bars 150 and 120, is defined by endplates 164 attached to and connecting the ends of the upper and lower bars 150 and 120.

The bends 82 and 114 in the mast 78 and extension arm 212, respectively, make the load bearing points on the center column 84 of the mast 78, the extension arm 212 and the tie bar assembly 136 a perfect rectangle, with contact points at all four corners. This geometry insures correct positioning of a load and simultaneously transfers the weight of the load from the load bearing points to the frame 22 in a manner that the lift 20 does not tip forward when the load center point of the load handling assembly 152 moves past the center point, i.e. the point of contact with the floor, of the front wheels 30. The bends 82 and 114 are also improvements over traditional cut angle and welded design features presently utilized in most lifts, which require extensive quality assurance measures to see that mechanical strength is 100% repeatable.

Figure 12:
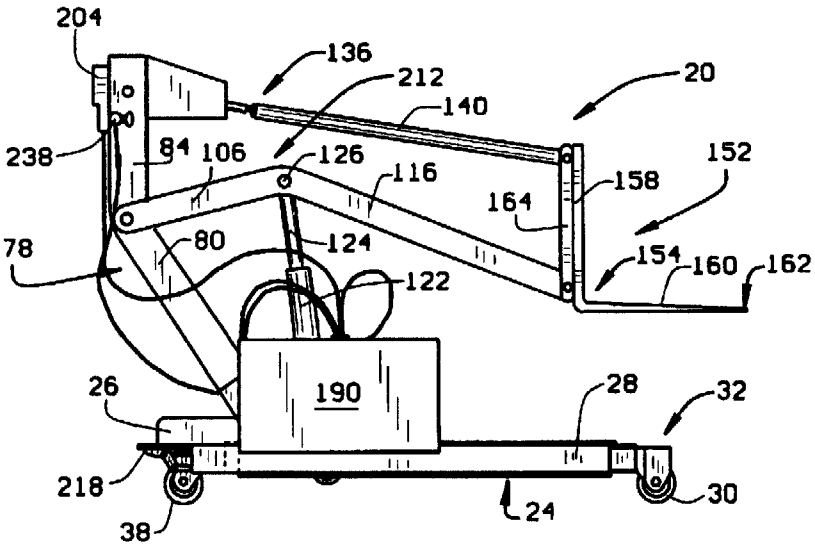
FIG. 12 is a side elevational view of the material handling lift.

According to the invention, the extension arm 212, tie bar assembly 136 and load handling assembly 152 may assume various positions. As illustrated in FIGS. 4 and 5, the extension arm 212 is shown in its downmost position with the load handling assembly 152 on the floor and the hydraulic lift cylinder 122 fully retracted. When the hydraulic lift cylinder 122 is extended, the extension arm 212 is raised. The broken lines corresponding to 166 show the extension arm 212 in its uppermost position. The distance between the two positions is a 49½-inch radial arc. The position of the load handling assembly 152 with the hydraulic lift cylinder 122 in a position with no tilt can be seen generally in FIG. 12. Pivoting movement of the forks 154 changes the angular position of the forks 154 relative to horizontal to facilitate engagement and disengagement with the load. Retraction of the hydraulic tilt cylinder 138 pivots the forks 154 in the opposite or counter-clockwise direction tilting the lower portions 160 of the forks 154 upwardly, as shown at 168. Extension of the hydraulic lift cylinder 122 pivots the forks 154 in a clockwise direction, thereby tilting the lower portions 160 of the forks 154 in the downwards direction, shown at 170. The maximum angle either direction in which the forks 154 may be tilted is 20 degrees. By utilizing directly related length and height correlation of the tie bar assembly 136 and extension arm 212 enables the load to remain in an adjustable range of tilt back, tilt forward or horizontal positions throughout its entire up and down lift cycle, dependant upon which original position was selected.

The hydraulic lift and tilt cylinders 122 and 138 are operated by a hydraulic pump (FIG. 7) as part of a hydraulic unit 172 that is located in a box 190 at the rear of the frame 22. The hydraulic unit 172 is shown generally in FIG. 23. The hydraulic unit 172 can be one manufactured by Monarch Hydraulics of Grand Rapids, Mich., model M687 Dynaramic pump. The hydraulic unit 172 has a tank 174 that is filled by with hydraulic fluid after removing the plug 176.

The motor 192 is connected to a battery 178 via a solenoid 180 located on top of the motor 192. The battery 178 can be a 12 V.D.C. deep cycle battery, with a recharger 182 (110 V battery charger).

The hydraulic lift and tilt cylinders 122 and 138 are connected the hydraulic pump 172 by hoses. Two tilt hoses 184 and 186 operate the hydraulic tilt cylinder 138 and lift hose 188 operates the hydraulic lift cylinder 122. As shown in FIGS. 6 and 20, the lift hose 188 extends from the tank 174 of the hydraulic pump 172, around the right side of the hydraulic lift cylinder 122, and attaches to a lower end of the hydraulic lift cylinder 122. The two tilt hoses 184 and 186 extend around the side of the mast 78, and enter into holes 194 and 196 located on the front of the lower portion of the mast 78, hose 184 going in the hole 196 and hose 186 entering into hole 194. Both hoses 184 and 186 extend the entire distance of the mast 78, and emerge from cavity 134 on the center column 84. Hose 184 attaches to the lower end of the tilt cylinder at 198, and hose 186 attaches to the upper end of the tilt cylinder at 200.

Figure 7:
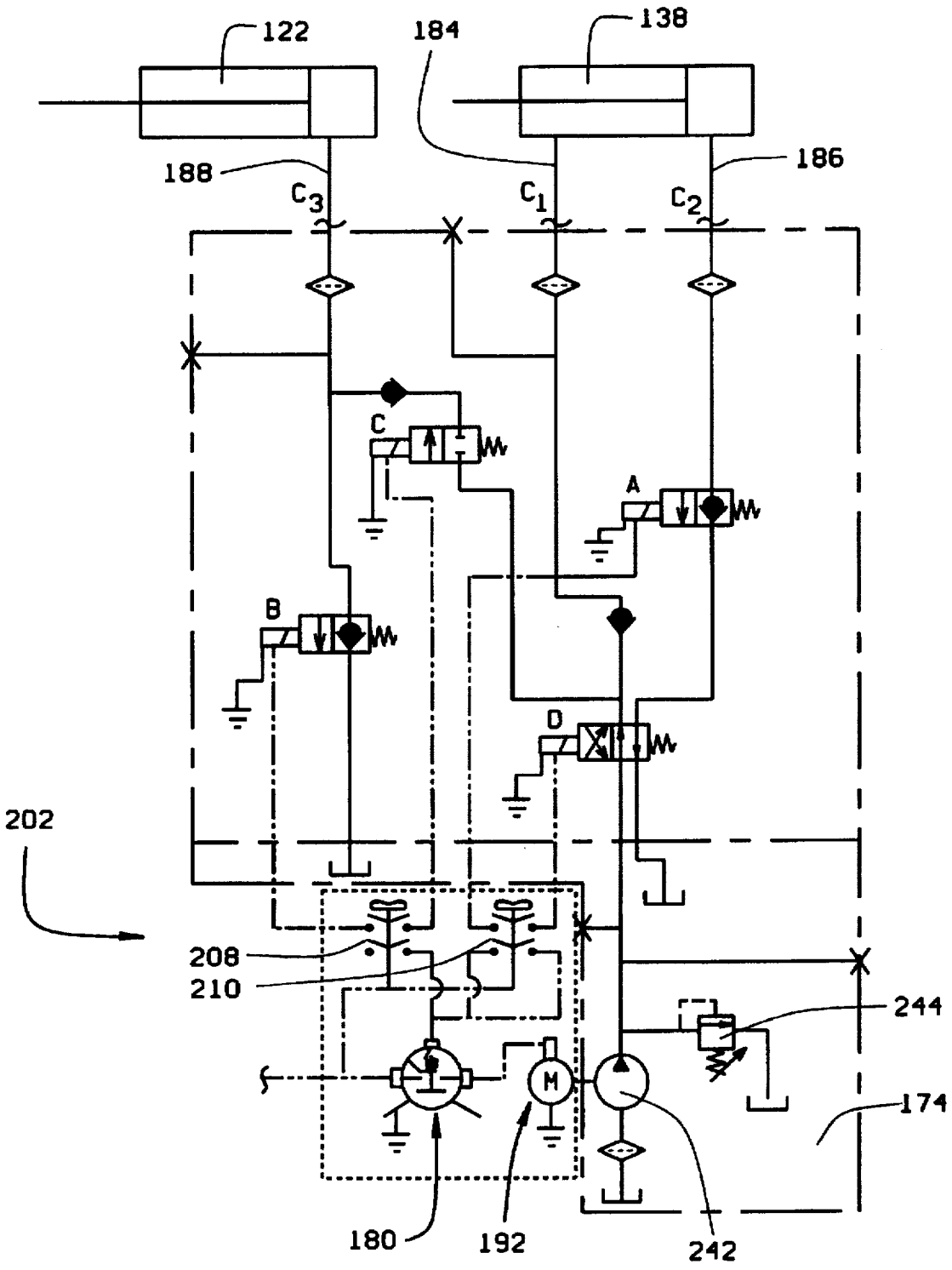
FIG. 7 is a schematic of the electrical and hydraulic circuitry used to power the hydraulic lift cylinders.

The hydraulic lift and tilt cylinders 122 and 138 are in a hydraulic circuit 202 and under the control of a remote hand control unit 204. One type of remote control 204 by usage is known as the "Guppy" manufactured by Harvard Industries of P.O. Box 370 Arnold, Mo. 63010. A schematic of the hydraulic circuit 202 is shown in FIG. 7. The hydraulic circuit 202 not only controls the forward, back and tilt mechanism, but includes a series of piloted check valves 206 to make the system a positive locking, positive positioning tilt mechanism which other hand operated lifts do not possess. The remote control 204 enables a person to stand adjacent to the front side of the lift while directing the load, thereby increasing visibility of the load movement as the hand control 204 is detachable from the mast 78.

Figure 11:
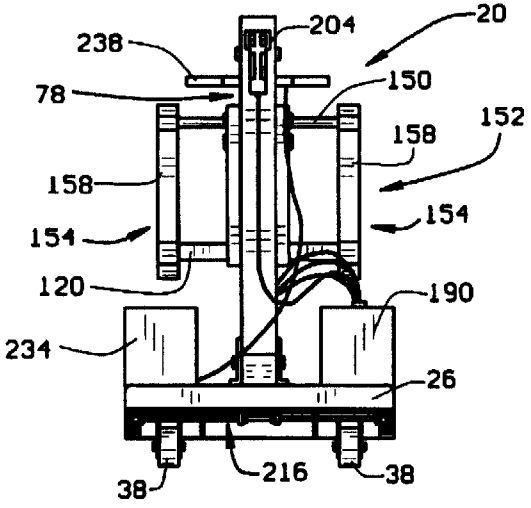
FIG. 11 is a rear elevational view of the material handling lift showing a foot brake on the bottom and the hand control clipped to the top of the mast.

The remote control 204 incorporates both tilt and lift features in a left button 208, which controls the up and down motions of the hydraulic lift cylinder 122, and a right button 210, which controls the forward and backward tilt of the load handling assembly 152. When the left button 208 is pushed forward, the hydraulic lift cylinder 122 directs the extension arm 212 down, and when the left button 208 is pushed back, the hydraulic lift cylinder 122 directs the extension arm 212 up. When the right button 210 is pushed forward, the load handling assembly 152 is tilted forward, and when the right button 210 is pushed back, the load handling assembly 152 is tilted back. The remote control 204 is also removable to render the hydraulic and electrical features of the lift 20 inoperable to unauthorized persons. The remote control can also be clipped on to the back of the mast 78, as in FIG. 11.

Figure 8:
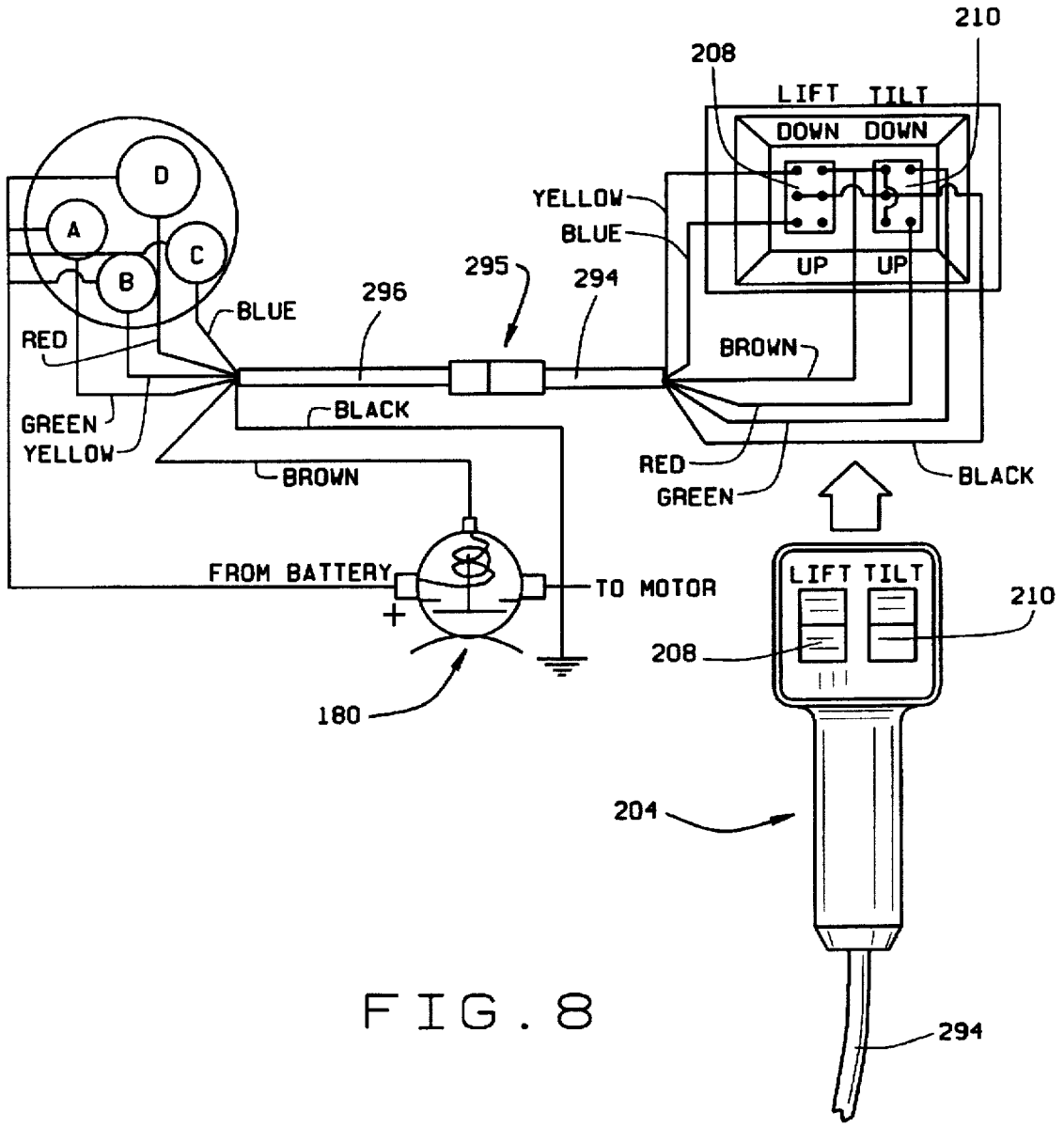
FIG. 8 is a front elevational view of the hand control, and a schematic of the electrical circuitry located therein in relation to the hydraulic valves.

Operation of the hydraulic system and associated control 204 will now be described. Referring in particular to FIGS. 7 and 8 the electrical and hydraulic schematics relating to operation is shown. The hand control 204 is shown with left and right up/down switches 208 and 210. These are connected via a wire bundle 294 through an electrical quick-disconnect 295 and electrical wire bundle 296 to the valve solenoids A, B, C, and D as well as the solenoid of 180. The solenoid 180 is connected to the motor 192 which is operably connected to the hydraulic fluid pump 242 within the hydraulic fluid tank 174. A safety release check valve 244 is disposed within the tank for relieving any excess fluid pressure back into the tank should this be necessary. Specifically, depressing the right rocker switch 210 on the hand control 204, completes the circuit through the brown wire to activate the solenoid 180 which thereby closes to run the pump motor 192 which is operably connected to the hydraulic pump 242. This action will also activate the solenoid valve A to direct hydraulic fluid pressure on the rear of the hydraulic tilt cylinder 138 thus moving the tilt assembly forward or tilting the forks forward. Depressing the right hand rocker switch 210 to the rearward position also activates the hydraulic pump 242 through solenoid 180 and motor 192 which also activates solenoid valve D via the red wire. This causes the hydraulic fluid to be forced into the rod end of the hydraulic tilt cylinder 138 via hose 184 thus moving the tilt assembly rearward or tilting the forks backward.

By depressing the left lift rocker switch 208 to the rearward position on the hand control 204 activates solenoid valve C via the blue wire. This forces fluid into the back or bottom side of the lift cylinder piston 122 via hydraulic line 188. This thus moves the lifting mechanism upward. By depressing the left lift rocker switch 208 to the forward position on the hand control 204 activates solenoid B via the yellow wire. This allows fluid on the back side of the piston to escape back to the tank thus causing the lifting of the mechanism or forks to be lowered. Both the right and left rocker switches 210 and 208 are spring loaded to the neutral position.

A foot brake 216 halts the movement of the entire lift 20. The foot brake 216 is operated by pushing down a pedal 218 that is axially mounted to a rod 220 which is situated under the support member 26 at the rear of the frame 22. When the pedal 218 is engaged by the foot, the rod 220 rotates and engages the locking mechanisms 224 located on the ends of the rod 220. The locking mechanisms 224 each have a lever 226 and a clip 228 pivotally attached in angular relation with each other. The levers 226 are pivotally mounted to the rod 220 diagonally with respect to the frame 22. The clips 228 run virtually parallel in relation to the frame 22 and are rigidly attached to the side rods 222. The locking mechanisms 224 thrust the side rods 222 forward when the rod 220 is rotated and the lever 226 is extended parallel with respect to the frame 22. When the side rods 222 are thrust forward, brake plates 230 attached to the ends of the side rods 222 engage the front wheels 30, thereby locking movement of the lift 20.

Figure 21:
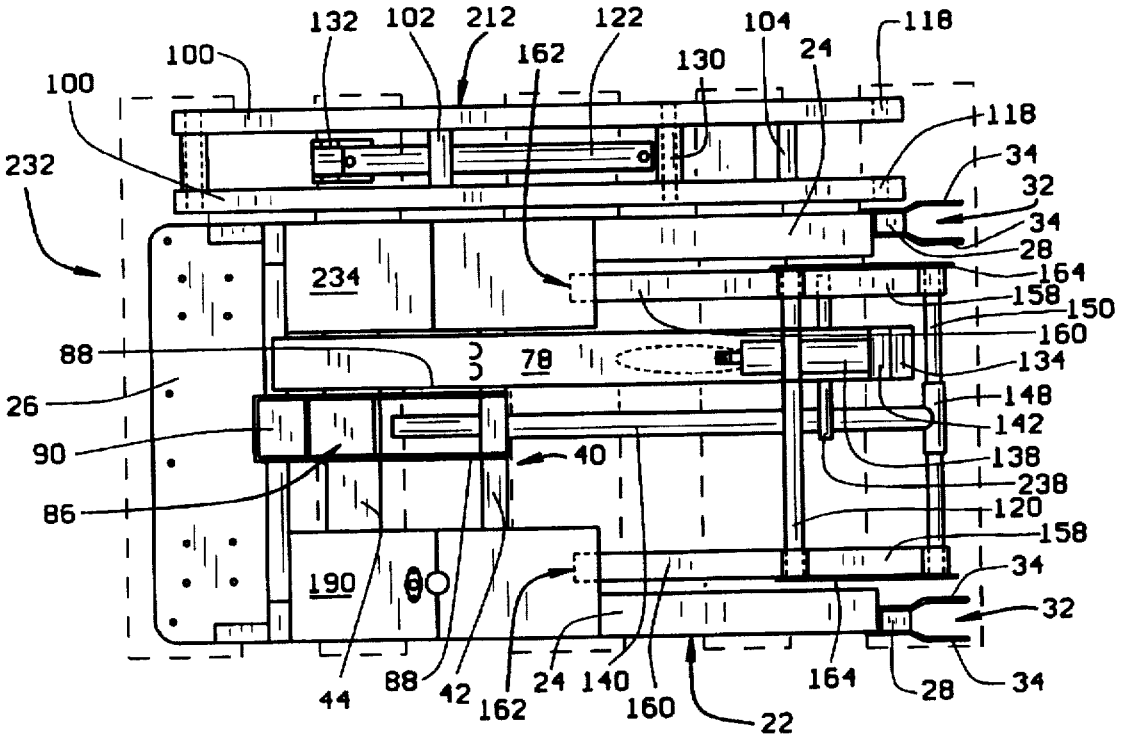
FIG. 21 is a top elevational view of a packed, disassembled material handling lift of the present invention with a shipping crate.
Figure 22:
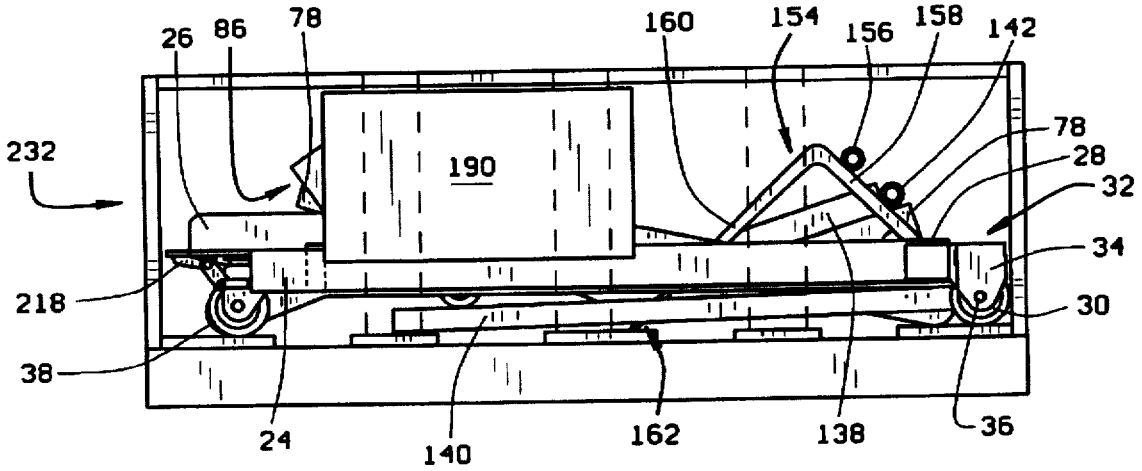
FIG. 22 is a side view of the crate containing the disassembled material handling lift.
Figure 23:
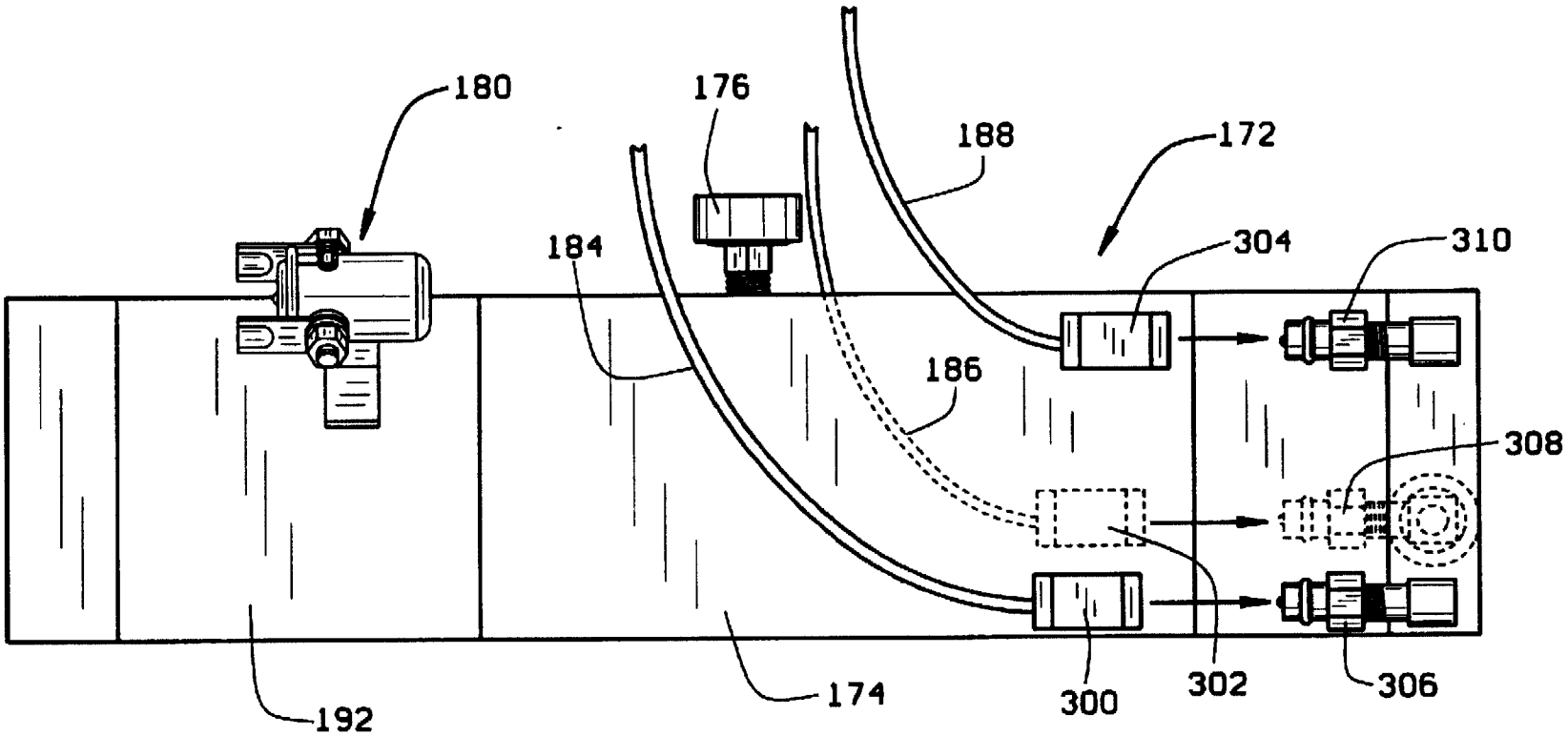
FIG. 23 is a side elevational view of the hydraulic module.

According to another aspect of the present invention, the material handling lift 20 can easily be disassembled by pulling pins 96, 98, 110, 146 and 214 and their corresponding pairs of hairpin clips that then allows the folding of the lift into a 40 inch width, 17 inch height and 60 inch length crate, making it simple to ship worldwide. The weight of the lift is 500–600 lbs. Referring to FIG. 23, the hydraulic unit 172 is depicted. The hydraulic hoses 184, 186 and 188 from the cylinders 122 and 138, terminate in female quick-disconnects 300, 302 and 304 respectively that releasably couple to male quick-disconnects 306, 308, and 310 respectively, that provide fluid communication to the hydraulic fluid tank 174. In addition, all electrical wiring has plugging features, to facilitate reassembly at its destination. FIGS. 21 and 22 illustrate how the lift 20 is packaged. The frame 22 supported by front and rear wheels 30 and 38 and the shuttle assembly 40 is positioned in the bottom portion of the box 232 with the hydraulic lift cylinder 122 and extension arm 212 placed adjacent to it.

Lift Operation

Figure 1:
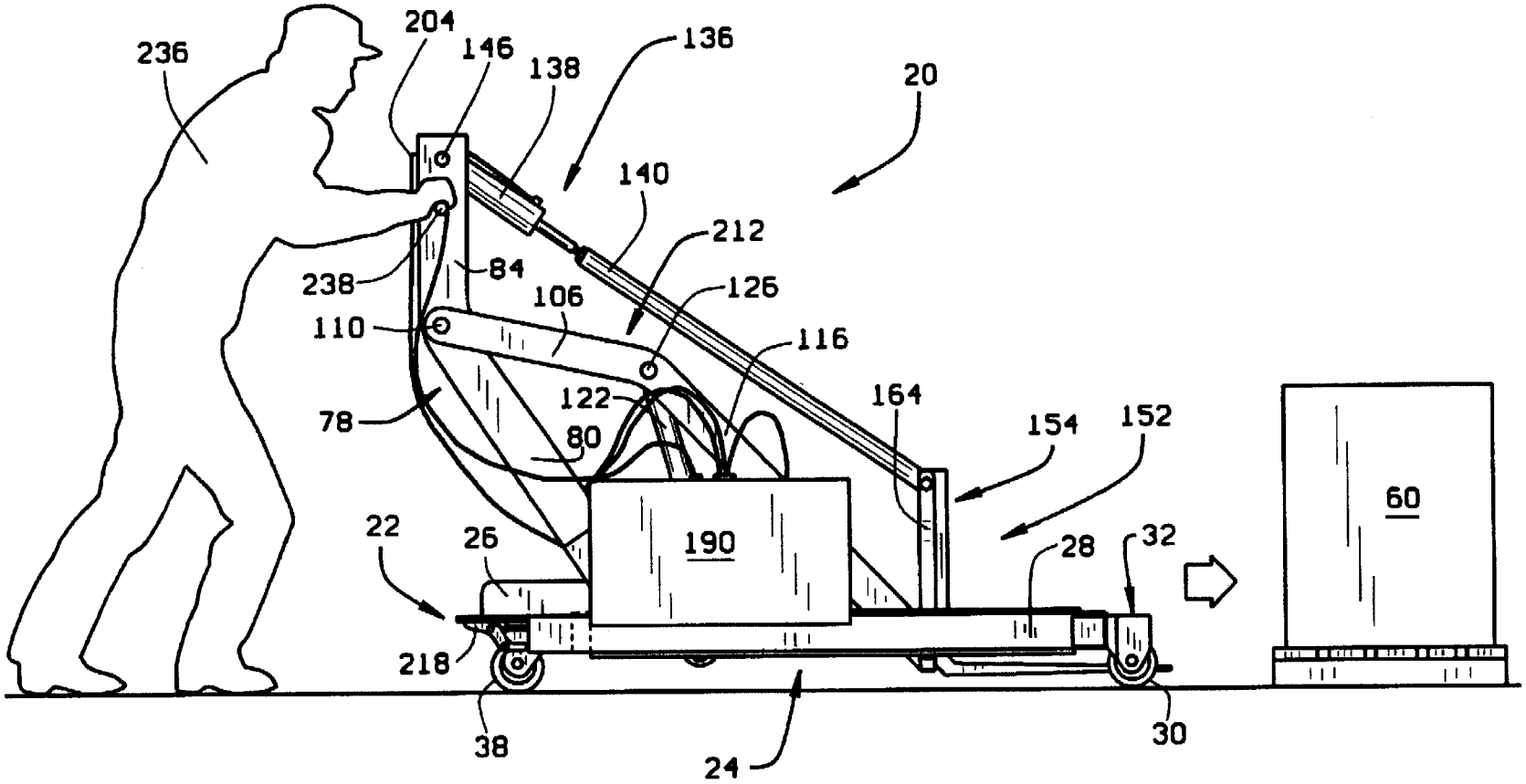
FIG. 1 is a side elevational view of a material handling lift embodying the present invention, showing an operator pushing the lift towards a load.
Figure 2:
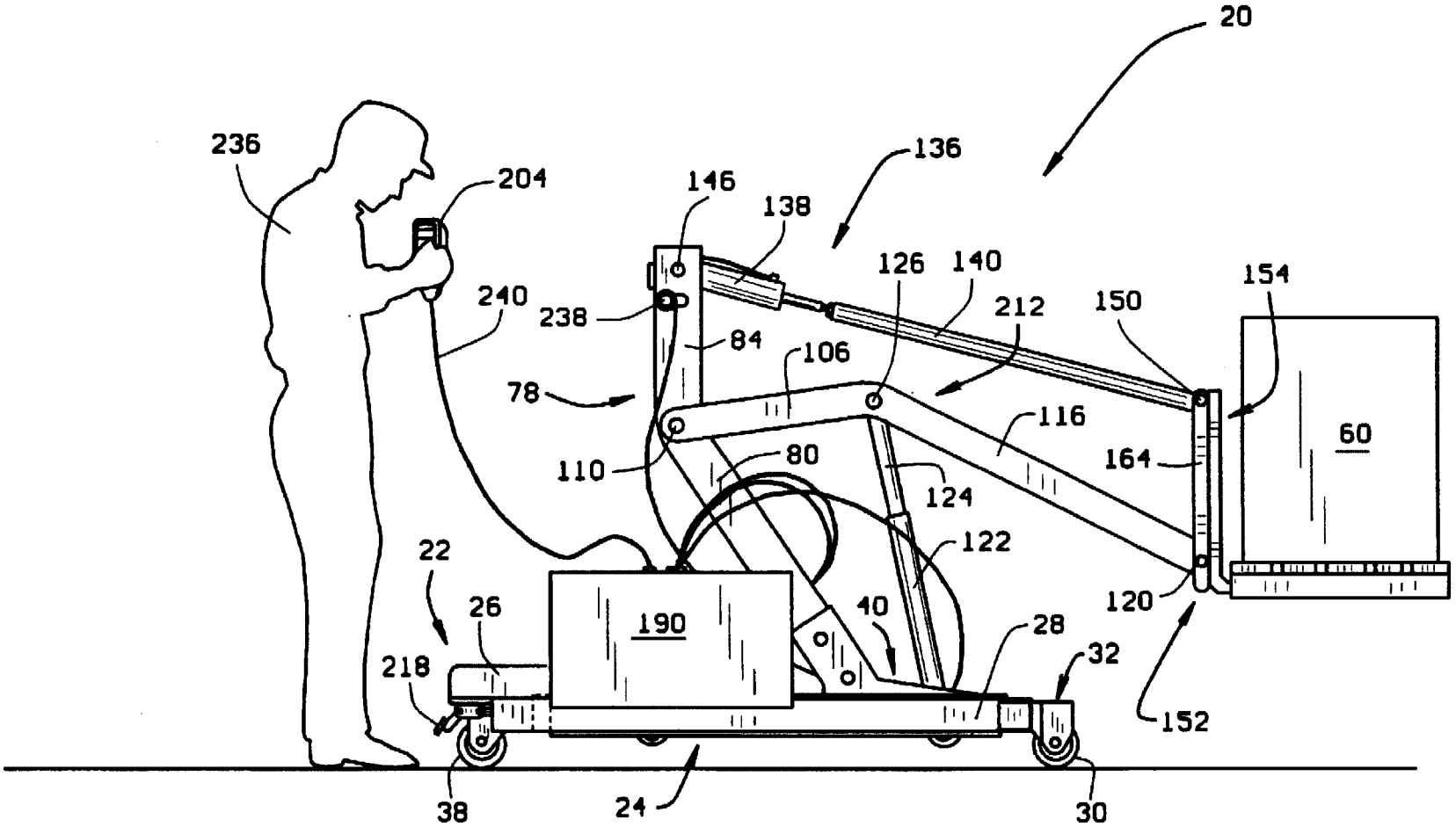
FIG. 2 is a side elevational view of the present material handling lift depicting the operator raising the load, through an associated detachable hand control.

In the operation of the material handling lift as described herein, the operator 236 is positioned at the rear of the machine over 48 inches away from the load handling assembly 152. Starting with the shuttle assembly 40 at its backmost position and the load handling assembly 152 on the floor, the operator 236 lifts the forks 154 approximately one inch off the ground by pressing the left button 208 on the remote control 204 back, to the position in FIG. 1. The operator 236 pushes the lift 20 forward, and if the load 60 is wider than the frame 22, the operator 236 releases the shuttle brake and pushes the shuttle assembly 40 forward, locks the shuttle brake, and positions the lower portions 160 of the forks 154 under the load 60. If the load 60 is not wider than the frame 20, the shuttle assembly 40 does not have to be repositioned. As in FIG. 2, the operator 236 then engages the foot brake 216 thereby halting movement of the lift 20, and lifts the load 60 off the ground by pressing the left button 208 on the remote control 204 forward, which raises the hydraulic lift cylinder 122 and the load handling assembly 152. The operator 236 then releases the shuttle brake and moves the shuttle assembly 40 again to its back position and moves the lift 20 forward towards the drop-off position of the load 60 as shown in FIG. 3.

Figure 3:
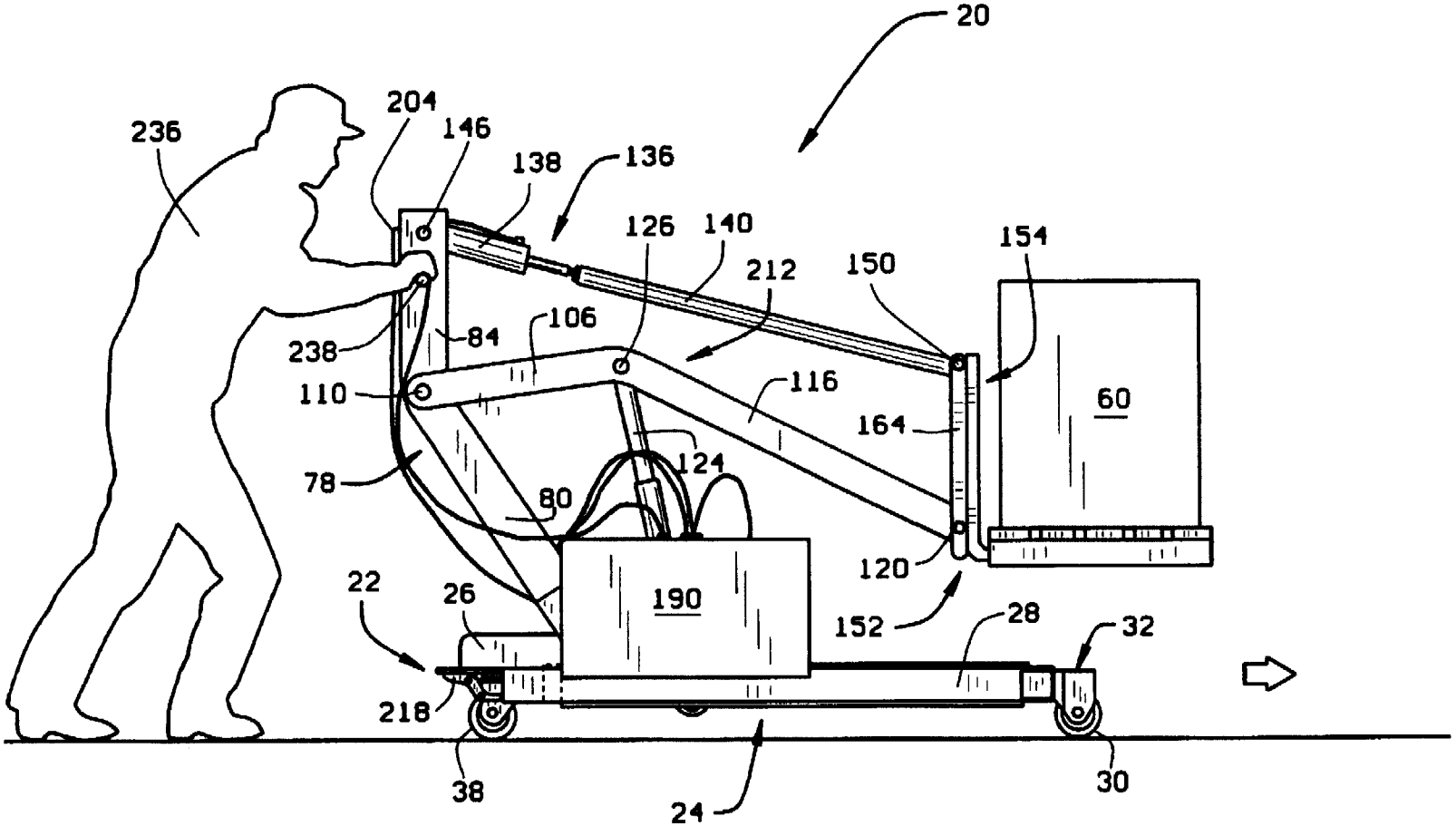
FIG. 3 is a side elevational view of the present material handling lift showing the operator transporting the lift with load forward or transporting position.

In addition to the upper position carrying of the load in FIG. 3, the load 60 could also be dropped onto the frame 22 and transported, due to the equalizing counter weight of the support member 26 located on the back of the lift 20. The load 60 can also be tilted forwards or backwards by pressing the right button 210. After the operator 236 has maneuvered the lift 20 to the position where the load 60 is to be displaced, such as, for example, on a table or a machine tool, the operator 236 raises the load 60 to the level of the surface. The operator 236 then releases the shuttle brake and moves the shuttle assembly 40 forward to the desired horizontal position, and then tilts the load 60 onto the platform.

It is apparent that many modifications and variations of this invention as hereinbefore set forth may be made without departing from the spirit and scope thereof. The specific embodiments described are given by way of example only and the invention is limited only by the terms of the appended claims.

What is claimed is:

1. A material handling lift comprising:

a) a frame having first and second parallel spaced longitudinal track rails, said first and second longitudinal track rails defining a frontward portion and a rearward portion, said rearward portions of said first and second longitudinal track rails connected by a lateral support member;

b) a shuttle assembly operably mounted within and between said first and second longitudinal track rails for longitudinal reciprocating movement therein;

c) a mast defined by a first section rigidly attached at one end to said shuttle assembly and extending a rearward angle relative thereto, and a second section extending from another end of said first section perpendicular to said longitudinal track rails;

d) a lift arm defining a first end and a second end, said first end pivotally coupled to said mast at the junction of said first and second sections of said mast, said lift arm having a downward bend located between said first and second ends;

e) a load carrying assembly having an upper bar and a lower bar coupled together at one end by a first endplate and at another end by a second endplate, and a pair of forks slidably mounted on said upper and lower bars for adjustable movement, said lower bar rotatably coupled to said second end of said lift arm;

f) a tilt arm pivotally attached at one end to said upper bar of said load carrying assembly;

g) a first extensible and retractable device secured at one of its ends to another end of said tilt arm, and pivotally coupled at another end to an end of said second section of said mast above said lift arm for angularly adjustably positioning said load carrying assembly with respect to said frame; and h) a second extensible and retractable device secured at one end to said shuttle assembly and pivotally secured at another end to said lift arm at said bend for raising and lowering said lift arms and thus said load carrying assembly.

2. The material handling lift of claim 1, further comprising:

a first longitudinal rectangular tube fixed to said first track rail on an outer surface thereof opposite said shuttle assembly; and a second longitudinal tube fixed to said second track rail on an outer surface thereof opposite to said shuttle assembly.

3. The material handling lift of claim 1, wherein said first and second extensible and retractable devices are hydraulic cylinders, and further comprising a hydraulic fluid tank and a hydraulic pump operably coupled to said tank and connected to and driven by an onboard power source to provide a hydraulic fluid under pressure from said tank for operating said hydraulic cylinders.

4. The material handling lift of claim 3, wherein said second hydraulic cylinder is a single acting cylinder and includes a flow compensating valve for slow and constant descent of said lift arm and said first hydraulic cylinder is a double action cylinder.

5. The material handling lift of claim 3, wherein said power source is a rechargeable battery, and in which said hydraulic pump is regulated by a solenoid coupled to said battery.

6. The material handling lift of claim 3, further comprising:

an electronic control circuit coupled to said power source, including a solenoid;

a remote control operably coupled to said electronic control circuit;

a hydraulic circuit, operably coupled to said pump including a plurality of valves for selectively directing and controlling the flow of hydraulic fluid into said hydraulic cylinders upon actuation by said remote control through said electronic control circuit, said hydraulic circuit having piloted check valves to positively lock and position said first hydraulic cylinder in a chosen position.

7. The material handling lift of claim 6, wherein said remote control is detachable from the circuit to render said hydraulic circuit and thus said hydraulic cylinders inoperable.

8. The material handling lift of claim 3, further comprising:

handle bars disposed on an upper portion of said mast proximate said tilt arm; and a shuttle brake operably coupled to said shuttle for selectively stopping longitudinal movement of said shuttle along said rails, said shuttle brake normally in a first state wherein said shuttle is prevented from longitudinal movement, said shuttle brake including a release attached to said handle bars and operably coupled to said shuttle brake, said release actuatable to position said shuttle brake into a second state, thereby allowing said shuttle to freely longitudinally move on said rails.

9. The material handling lift of claim 8, wherein said shuttle brake comprises:

a U-bracket coupled to one of said end plates of said shuttle assembly, said U-bracket having a bore therethrough;

a first plate having a boss at one end and pivotally coupled to a second plate having a boss at one end by a pivot pin extending through said bosses;

a first spring coupled to and between said first and second plates, said first spring normally biasing said plates together such that said plates contact said upper rail to stop movement of said shuttle assembly;

a stop arm pivotally disposed on said shuttle assembly and biased by a second spring to allow said plates to be biased together, said stop coupled to said release whereby actuation of said release overcomes tension of said second spring to spread apart said first and second plates whereby said plates release contact with said upper rail to allow movement of said shuttle assembly.

10. The material handling lift of claim 1, wherein said frame is movably carried on wheels and further including a foot brake incorporated into said frame for controlling the braking of said material handling lift, said foot brake comprising:

a) a hollow rectangular tube disposed within one of said rails;

b) a rod situated under said lateral support member;

c) a pedal axially mounted to said rod and adapted to rotate said rod when engaged by the foot of an operator;

d) a pair of side rods positioned inside the entire length of said rectangular tubing;

e) a pair of locking mechanisms each comprising two levers in angular relation with each other, the first lever pivotally mounted to said rod diagonally with respect to said frame, said second lever substantially parallel in relation to said frame and pivotally mounted at one end to said first lever and rigidly attached at the other end to said side rods, each said locking mechanism thrusting said side rods forward when said rod is rotated and said first lever is extended parallel with respect to said frame; and f) a pair of plates attached to the ends of said side rods, said plates having a tip with a longer top end diagonally extending downward towards a shorter bottom end, for engaging one of the wheels when said side rods are thrust forward, thereby halting movement of the wheel.

11. The material handling lift of claim 1, wherein said lateral base member is a counterweight for preventing said material handling lift from tipping forward when a load disposed on said forks extends past the front end of the frame.

12. The material handling lift of claim 1, wherein said forks are adjustable along the lengths of said upper bar and said lower bar, said first and second endplates defining a maximum width for which said forks may be adjusted.

13. The material handling lift of claim 1, further comprising five pins with two hairpin clips per pin, the first pin pivotally securing said second extensible and retractable device to said mast, the second pin pivotally securing said lift arm assembly to said mast, the third and fourth pins securing said mast to said shuttle assembly, and the fifth pin pivotally securing said first extensible and retractable device to said shuttle assembly.

14. The material handling lift of claim 13, wherein said shuttle assembly comprises:

a) a frame having a pair of parallel spaced support members positioned laterally with respect to said track rails, each support member having two ends, and a pair of end plates positioned parallel with respect to said track rails, each of said endplates attached to one of said two ends of each of said support members, to thereby define four load points on said frame, each said load point located where said end plates attach to said support member;

c) four bearing shafts, each bearing shaft mounted proximate one of said four load points of said frame;

d) four rollers, each roller mounted onto one of said four bearing shafts and disposed within a respective said channel of said track rails, each of said rollers having a radiused wheel to enable minimal lateral movement; and e) four guide wheels, each said guide wheel attached to one of said four load points of said frame, each guide wheel having a bearing mounted vertically onto said support member thereby positioning each guide wheel parallel to said frame, each guide wheel further having a rolling surface in contact with an inward facing end of a respective upper bearing rail for directing forward and backward movement of the shuttle assembly along the said track rails.

15. The material handling lift of claim 1, further comprising two front wheels and two rear casters, said front wheels attached axially to a pair of side brackets extending from said rails and movable only in the forward and backward directions with respect to said frame for driving said lift, said rear casters mounted at the rear of said frame and movable in all directions for steering said lift.

16. The material handling lift of claim 1, wherein said mast, said lift arm, and said shuttle assembly forms a rearwardly projecting triangle that transfers the weight of a load onto said load carrying assembly to said rails.

17. A collapsible material handling lift comprising:

a frame including two spaced apart parallel I-beam rails coupled together at one end by a transverse member, each said rail defining a longitudinal channel therein;

a shuttle assembly defined by a rectangular frame having a wheel at each corner thereof and adapted to be received in said channels such that said shuttle assembly is longitudinally reciprocal therealong;

a mast defined by a first section and extending a rearward angle relative to said shuttle assembly, and a second section extending from an end of said first section perpendicular to said rails, said mast detachably coupled to said shuttle assembly by a first removable pin;

a lift arm detachably coupled to said mast approximately midway therealong by a second removable pin;

a hydraulic lift cylinder detachably coupled at one end to said shuttle assembly by a third removable pin, and detachably coupled at another end to said lift arm by a fourth removable pin;

a tilt arm including a hydraulic tilt cylinder operably coupled at one end of said tilt arm, said hydraulic tilt cylinder detachably coupled to said mast above said lift arm by a fifth removable pin; and a fork assembly including a lower bar pivotally coupled to said lift arm opposite said mast, an upper bar coupled to said tilt bar opposite said mast, first and second end bars disposed on the ends of said upper and lower bars and extending therebetween, and a pair of forks coupled to and adjustably movable along said upper and lower bars.

18. The collapsible material handling lift of claim 17 further comprising:

a power source carried by said frame;

a hydraulic controller including a hydraulic fluid source, pump and motor operable couplable to said cylinders, said motor and pump operably coupled to said power source; and a detachable hand control operably coupled to said power source and said hydraulic controller for operating the lift.

19. The collapsible material handling lift of claim 17 wherein the lift weighs between 500–600 lbs.

20. The collapsible material handling lift of claim 17 wherein the lift packs into a 17" high×60" long×40" wide container.

* * * * *